US006777604B1

(12) United States Patent
Sanderson

(10) Patent No.: US 6,777,604 B1
(45) Date of Patent: Aug. 17, 2004

(54) INSERTABLE MUSICAL KEYBOARD DEVICE WITH MOVING INSERTS TO DETECT KEY MOVEMENT

(75) Inventor: Stephen N. Sanderson, Albuquerque, NM (US)

(73) Assignee: Stephen N Sanderson, Albuquerque, NM (US)

( * ) Notice: Subject to any disclaimer, the term of this patent is extended or adjusted under 35 U.S.C. 154(b) by 0 days.

(21) Appl. No.: 10/064,795

(22) Filed: Aug. 18, 2002

(51) Int. Cl.[7] ..... G10C 3/12

(52) U.S. Cl. ..... 84/423 R; 84/433; 84/477 R; 84/478; 84/137; 84/169

(58) Field of Search ..... 84/423 R, 433, 84/477 R, 478, 137, 169

(56) References Cited

U.S. PATENT DOCUMENTS 4,790,230 A * 12/1988 Sanderson ..... 84/462
6,037,534 A * 3/2000 Yasutoshi et al. ..... 84/477 R
6,472,589 B1 * 10/2002 Lee ..... 84/21

* cited by examiner

*Primary Examiner*—Shih-Yung Hsieh

(57) ABSTRACT

A portable modular apparatus that simply and unobtrusively mounts on the top of a piano or keyboard, and detects key movement. The rectangular back side of the modular apparatus serves to effectively mount the apparatus. The self-mounting portable apparatus has associated with each key an optical coupler. The self-mounting portable apparatus has associated with each black key a thin, reflective, flexible insert that positions itself between its respective key and optical coupler when the portable apparatus is mounted. The reflective insert then moves in relation to the movement of its respective key.

6 Claims, 7 Drawing Sheets

INSERTABLE MUSICAL KEYBOARD DEVICE WITH MOVING INSERTS TO DETECT KEY MOVEMENT

BACKGROUND OF INVENTION

There have been many ways sought to detect key movement on pianos and keyboards. Electronic keyboards have the advantage of building in key detecting devices during its design and manufacturing. However, some older electronic keyboards, organs, and pianos are not equipped with key detecting devices and circuitry. Pianos can be retrofitted with sensor units underneath the piano keyboard, and there are retrofit systems that operate using different technologies. One of these technologies uses optical couplers to detect or monitor the activity of the key. Many applications use the optical coupler principle to monitor key activity from beneath the key while others monitor the key activity from atop the keyboard.

Patents U.S. Pat. No. 5,567,902, U.S. Pat. No. 5,231,283, and U.S. Pat. No. 5,763,806 use optical sensing from underneath the piano keys to accomplish the detection of black and white key movements. None of these however have addressed optically sensing the black and white keys from the top of the keys. It would be desirable to have a portable key detection apparatus for over the top of the keys.

U.S. Pat. No. 5,394,784 discloses an apparatus seemingly attached to the topside of the keyboard. However, its objective is to display key information with visual LEDs. It assumes that the keyboard it rests on has the capability of detecting key movement. It would be desirable not to rely on the piano's or keyboard's capability, but to independently provide the capability of detecting key movement.

U.S. Pat. No. 4,448,103 discloses an apparatus that rest over the top of the piano keys. By its nature and principle of operation, it is bulky, and it would most notably be difficult to provide an effective way to mount and stabilize the housing. The invention chooses to describe mounting "by any appropriate means such as a bracket, adhesives or adhesive tape, screws or bolts, etc." It would be desirable to have a thin, light weight, unobtrusive apparatus without additional bulky, unattractive end pieces and procedures. It would be desirable to stabilize the device in a suitable, simple, and effective manner.

U.S. Pat. No. 4,790,230, discloses a keyboard device that is mounted on top of a keyboard and uses optical sensing for detecting key movement. However, while the invention is suitable for detecting white key movement, it is inadequate to accurately detect and transmit black key movement due to inadequate amounts of reflected signals from the black keys.

Further, U.S. Pat. No. 4,790,230 states that to compensate for the black key's color, each black key's optical emitter signal strength can be increased. However, this introduces stray reflected light that would interfere between adjacent white keys. Unless a means is provided to shroud or block the adjacent stray light interference, the invention's goal of treating all keys alike is inadequate and unsuitable. It would be desirable to avoid special operational treatment of signal strengths due to the significant difference between the black key and white key reflectivity. Rather, it would be desirable to simply increase the reflective properties associated with of the black key movement.

Accordingly, it is a primary object of the present invention to provide a portable, lightweight, and unobtrusive apparatus for detecting piano/keyboard key movement that compensates for the deficiency of the black key reflective properties.

It is another object of the present invention to disclose means to apply thin, reflective, flexible inserts that position themselves between their respective black key and optical device.

It is another object of the present invention to provide a simple attachment means utilizing the mechanical design of the device to easily mount and provide stability in the detection of piano key movement.

SUMMARY OF INVENTION

The goal of the present invention is to provide a modular and portable means to detect key movement and velocity on virtually any available piano or keyboard. A device such as this would enhance and enrich performances, compositions, and piano keyboard training given the sophisticated computer programs and sound hardware available. The present invention is installed between the black keys and fallboard or keyboard casing, spanning any number of keys or octaves up to the full length of a keyboard. Interconnecting circuitry contained in the invention attaches to a local or internal processor unit. The processor unit analyzes and converts the detected key movements into a format suitable for further transmission to a computer or musical device sharing the same protocol and physical interface such as MIDI.

The present invention uses one optical transmissive coupler per key. Each optical transmissive coupler, or optocoupler, has an emitter and phototransistor. The optocoupler, detects key movement by generating a light signal from its emitter and detecting the reflected signal from the key with its phototransistor. The white key optocoupler is positioned near the white key. The emitter signal is reflected off the white key and detected by the phototransistor. The black key optocoupler is positioned near the black key. Since the emitter signal reflected off the black key is too weak for accurate detection of the black key movement by the phototransistor, each black key is equipped with a reflective insert. There are two types of reflective inserts to be described: vertical flaps and horizontal drapes. The inserts move or glide with the black key movement. The emitter signal is now reflected off the reflective insert and detected by the phototransistor.

The present invention takes advantage of the inconspicuous narrow gap between the back of the black keys and piano fallboard or electronic keyboard casing. The rectangular design of the back side of the present invention provides an ideal mounting means between the black keys and the piano fallboard or musical keyboard casing. The snug fit eliminates the need for end-mounting hardware and provides stability during use. If the gap between the black keys and the fallboad are wider than normal, additional rectangular strips of varying thickness can be installed behind the backside cover to keep the present invention firmly in place.

BRIEF DESCRIPTION OF DRAWINGS

FIG. 4*a* illustrates when the white key is played (in a down position) and when the black is at rest(in the up position). FIG. 4*b* illustrates the flap's movement outward when the black key is played (in a down position).

FIG. 5*a* illustrates when the white key is played (in a down position) and when the black is at rest(in the up position). FIG. 5*b* illustrates the drape's movement downward when the black key is played (in a down position).

DETAILED DESCRIPTION

Figure 1:
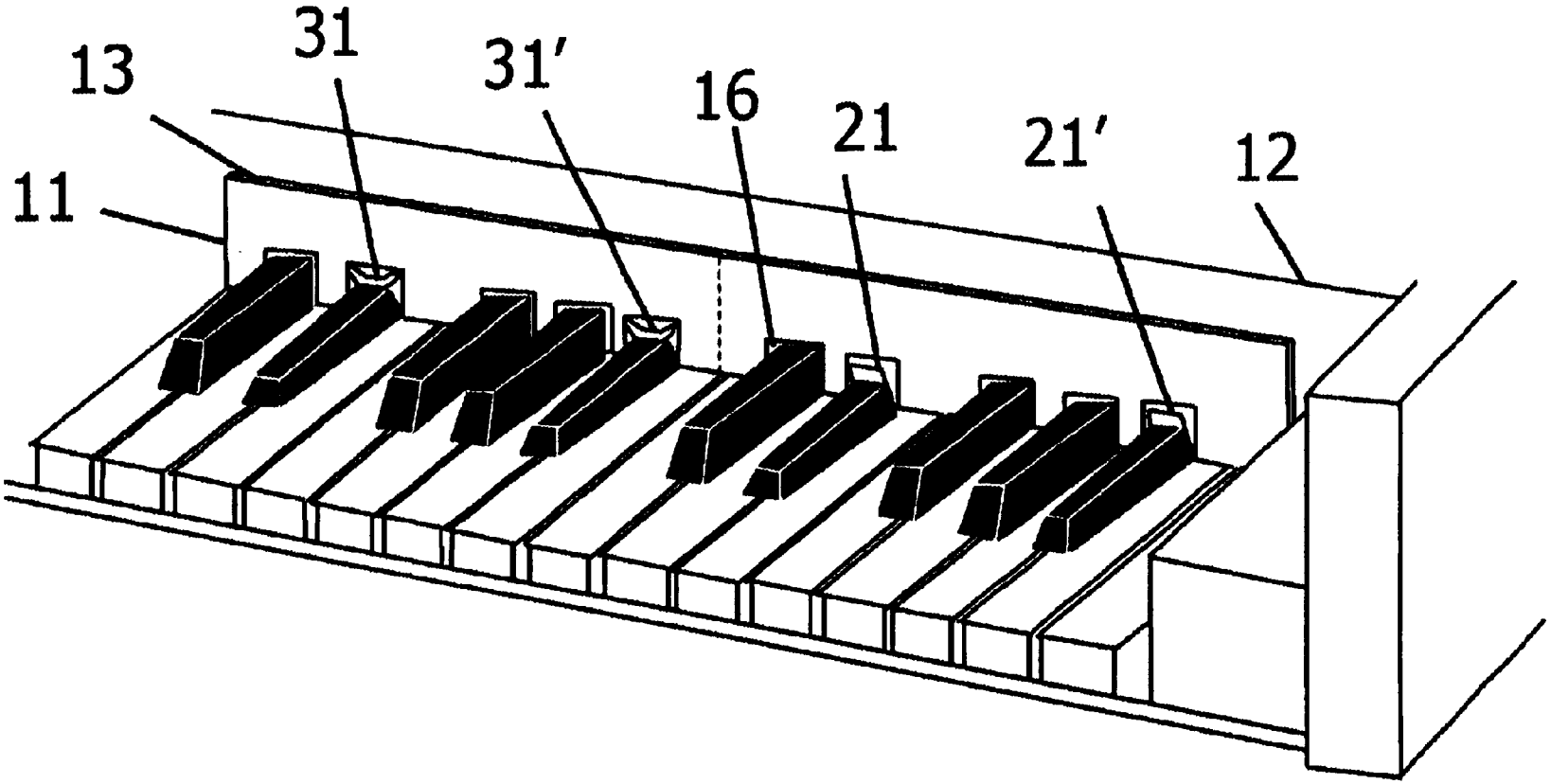
FIG. 1 is a perspective view of a representative portion of a piano/keyboard and how the present invention would appear. The invention consists of a rectangular backside cover, circuit board, optocouplers, black key inserts, housing, and electrical connection. The figure illustrates both the vertically mounted reflective flaps and horizontally mounted reflective drapes.

The invention is streamline and very thin when compared to the usable portion of the piano/keyboard keys shown in FIG. 1. The front side of the housing 11 is comb-shaped while the back side of the housing is rectangular and connects to the front side housing. The rectangular back side cover installs between the black keys and the piano fallboard 12. The invention's housing 11 accommodates both the flap and drape reflective inserts as shown. The comb-shape openings of the housing 11 allow the flaps 21 to move freely outward when the black keys are played. The comb-shape openings of the housing 11 also serve as mounting points for the drape inserts 31 so they remain fastened on the ends while moving downward when the black keys are played.

Figure 2:
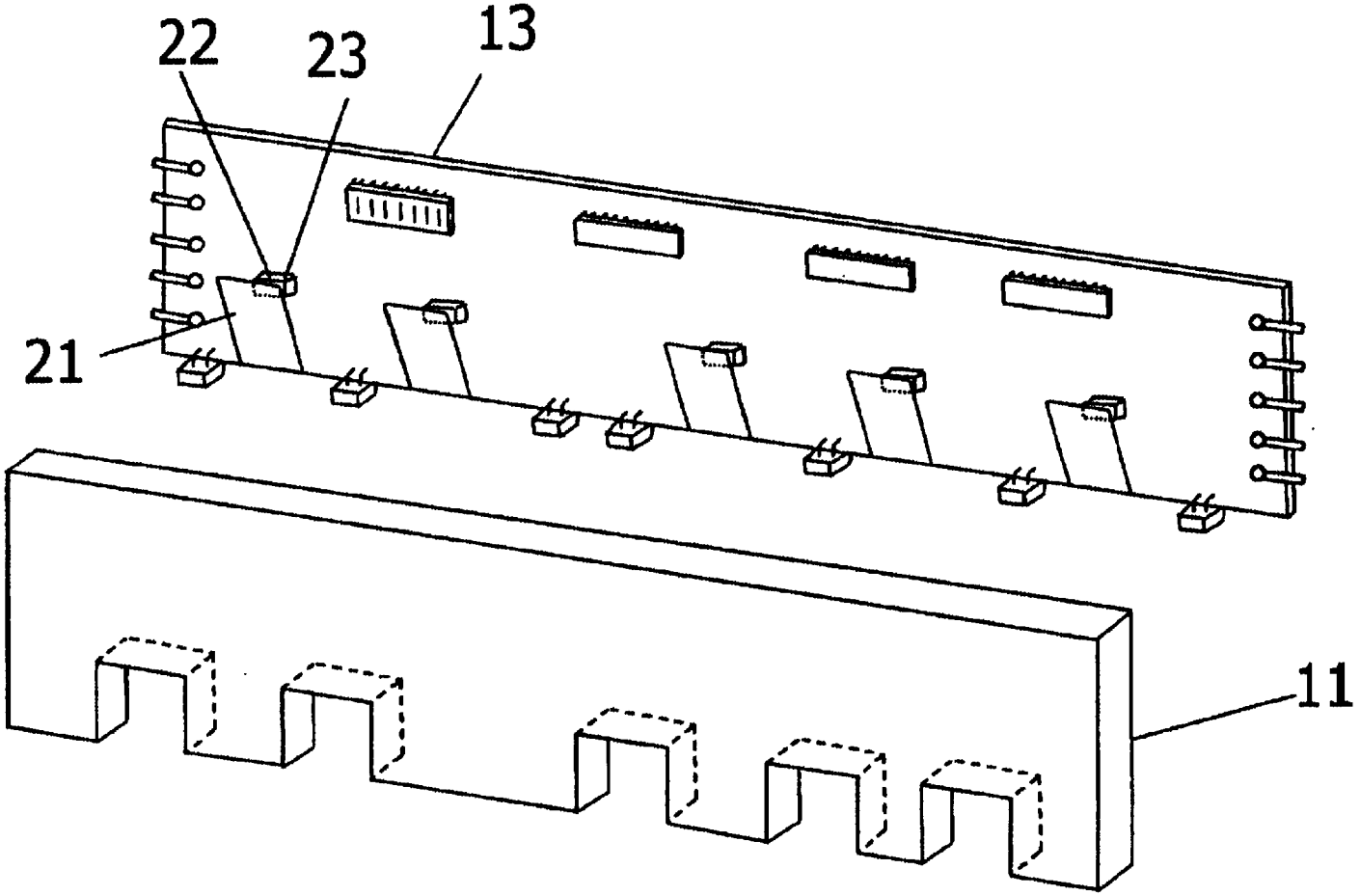
FIG. 2 shows a representative portion of the present invention fitted with vertically-mounted reflective inserts, or flaps. The figure illustrates a portion of the present invention that would cover an octave consisting of twelve keys, seven white keys and five black keys.
Figure 3:
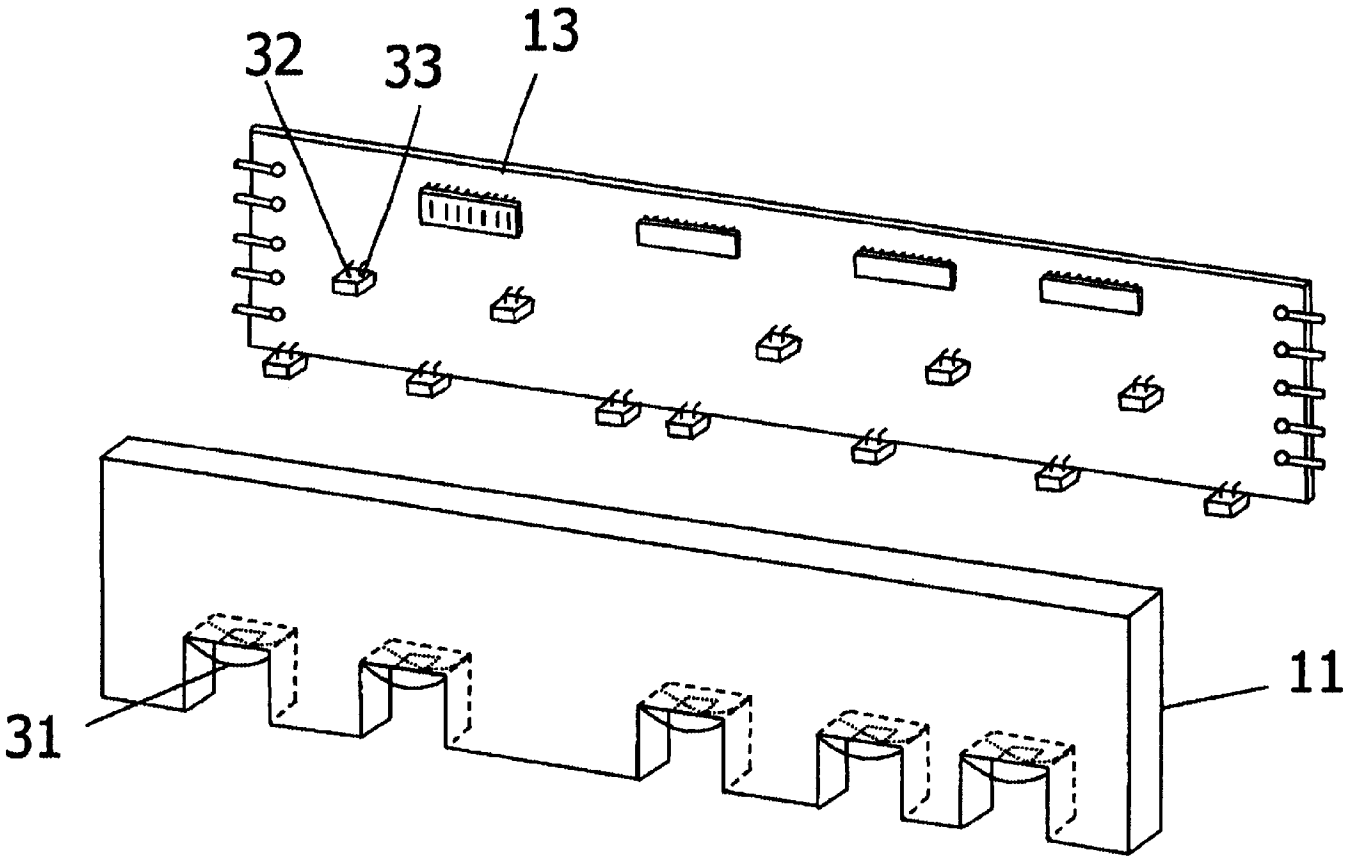
FIG. 3 shows a representative portion of the present invention fitted with horizontally-mounted reflective inserts, or drapes. The figure illustrates a portion the invention that would cover an octave consisting of twelve contiguous keys, seven white keys and five black keys.

The printed circuit board 13 as shown in FIG. 2 and FIG. 3 is equipped with optocouplers, control, and monitoring circuitry. Technology has advanced to the point of using surface mount size devices to alleviate the bulk and dimensional problems of circuit devices, thus keeping the profile of the circuit board and parts extremely low.

The exploded view of FIG. 2 shows vertically-mounted reflective inserts, or flaps. The flap 21 is very thin, on the order of paper-thickness, allowing the flap to be inserted with the rectangular circuit board 13 between the black key and the piano fallboard 12. The flap is made of a material that can keep its form while having a spring-like effect when pushed on by the black key. The optocouplers (22 and 23) used for flap operation are installed with the active surface pointed outward toward the flap. The flap surface facing inward toward the optocoupler is of a light or white color so the signal reflection is comparable to the level of a white key. The flap surface facing outward can be of a darker color to blend in the esthetics of the invention's housing. It is to be noted that if there was ample room between the black key and the fallboard or if technology advances to the point of micro-miniature surface mount optocouplers, the optocoupler could be lowered downward and located directly between the black key's back side and fallboard. The flap would not necessarily be needed then since the black key's backside color is not black but has a wood-grain appearance. This would be serve as a suitable reflective surface.

The exploded view of FIG. 3 shows horizontally-mounted reflective inserts, or drapes. The drape 31 is made of a thin, somewhat elastic material that can fall with gravity easily. The drape can be as wide as the invention's housing 11. The drape is installed in the comb-shaped of the housing 11. The optocouplers (32 and 33) used for drape operation are installed with the active surface pointing downward. The optocouplers are brought over the top of the drapes as the housing 11 and rectangular circuit board 13 is assembled. The drape surface facing upward toward the optocoupler is of a light or white color so the signal reflection is comparable to the level of the white key.

Once the invention is installed between the black keys and the piano fallboard or keyboard casing, the flaps or the drapes serve to vary the amount of reflected light, generated from the optocoupler's photo-emitter 22. The reflected light is detected by the optocoupler's phototransistor 23. Typically, a pre-determined amount of light is transmitted out the optocoupler's emitter 22. The amount can be fixed or determined during the initialization and calibration setup of the overall system. In either case, the amount of light reflected back to the phototransistor 23 is at its maximum when the black key is at rest and at its lowest when the black key is completely depressed. The key movement detection levels are furthered acquired and compared to predetermined white key and black key ON/OFF thresholds. Also, note velocity can be determined based on the speed of the acquisition system.

Figure 4A:
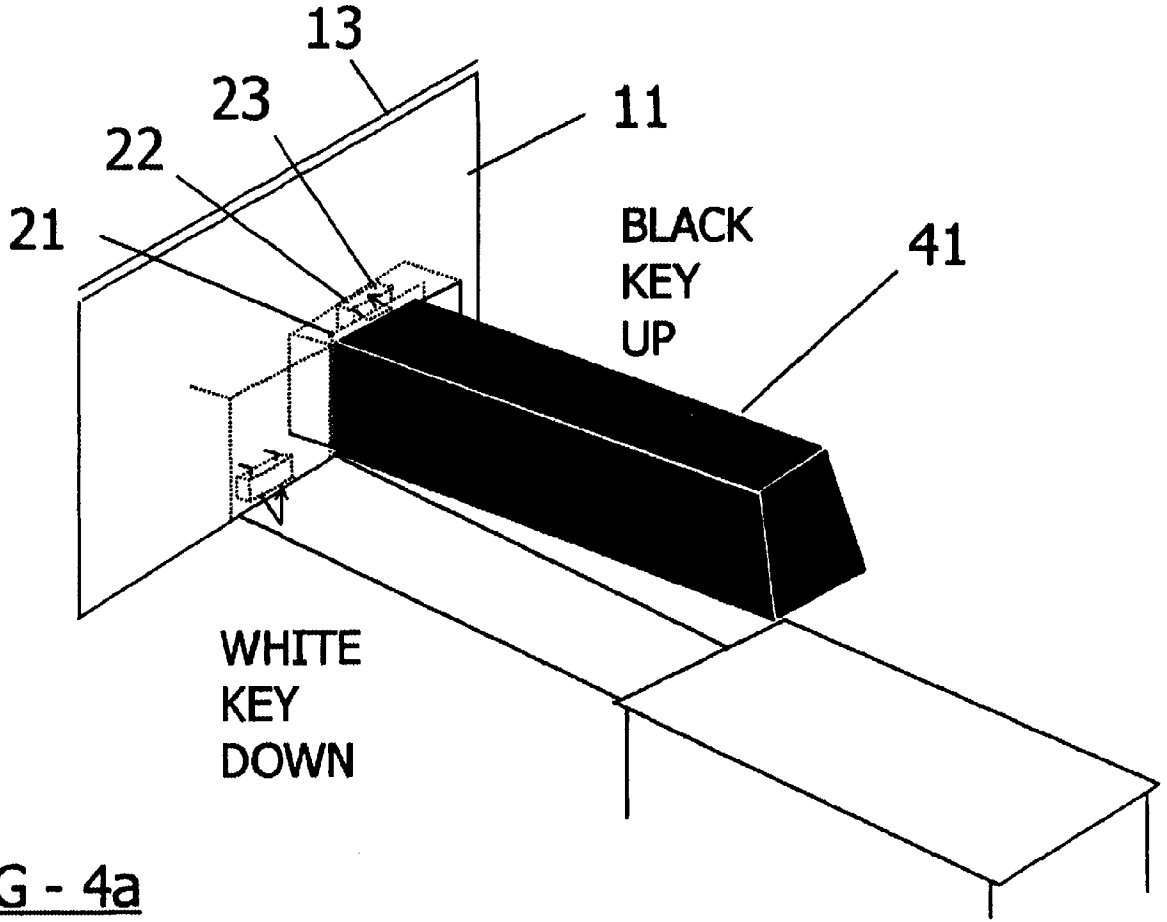
FIGS. 4*a* and 4*b* is a cutaway perspective specifically illustrating the flap principle of operation.
Figure 4B:
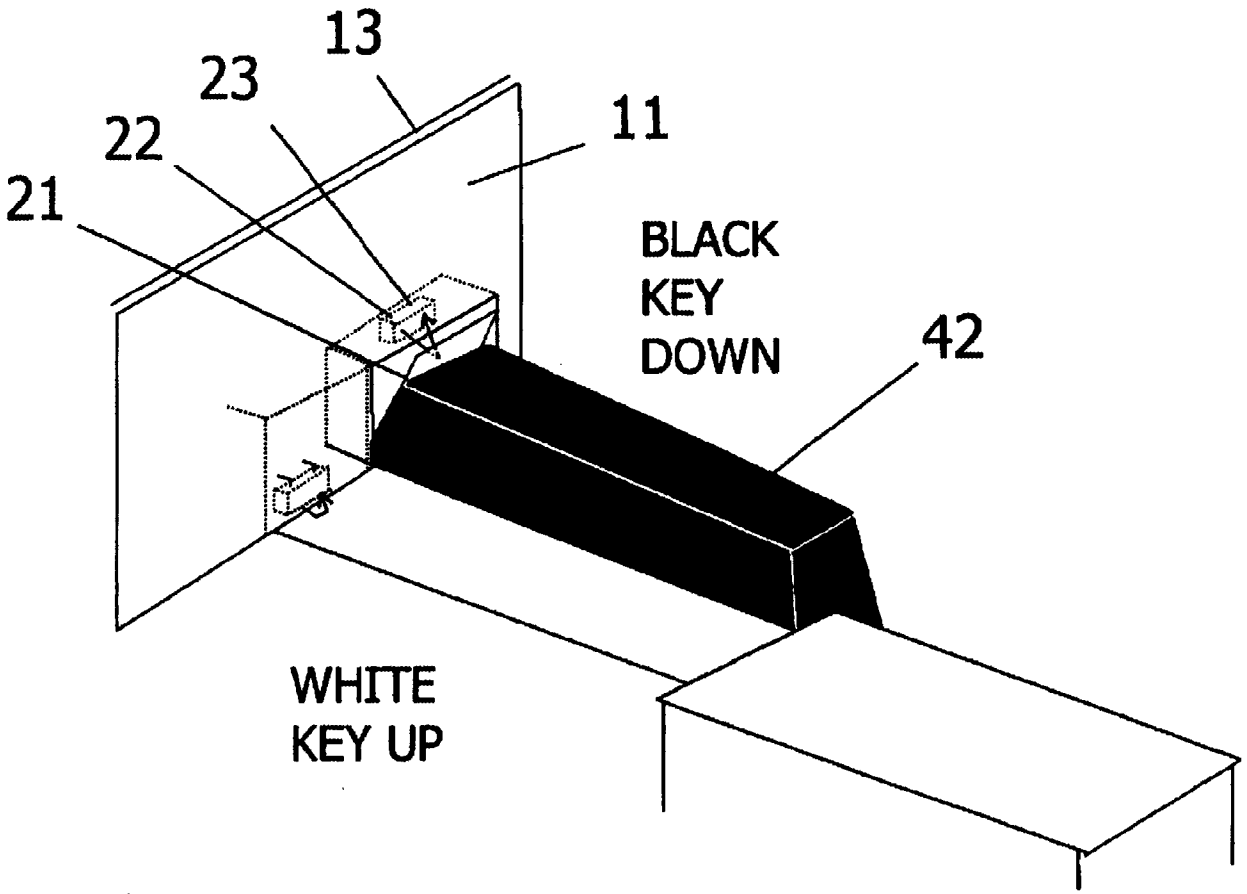

In the case of the vertically-mounted insert, or flap, as shown in FIG. 4, the black key 41, at rest, pushes the flap 21 back against the optocoupler. As the black key is played and moves to the down position 42, the flap 21 moves out and away from the photo-emitter 22. This causes less light to be reflected, and the phototransistor's 23 signal decreases.

Figure 5A:
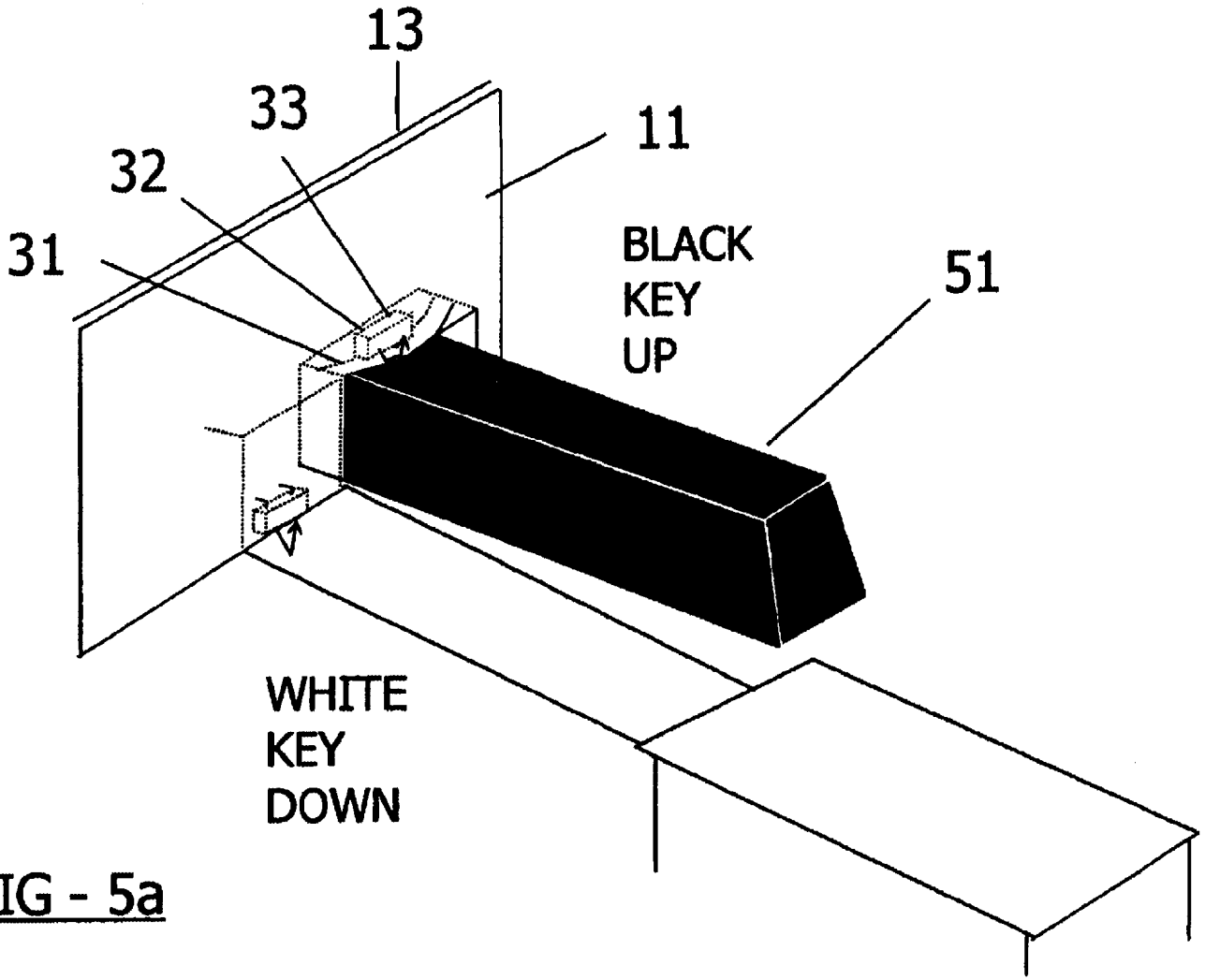
FIGS. 5*a* and 5*b* is a cutaway perspective specifically illustrating the drape principle of operation.
Figure 5B:
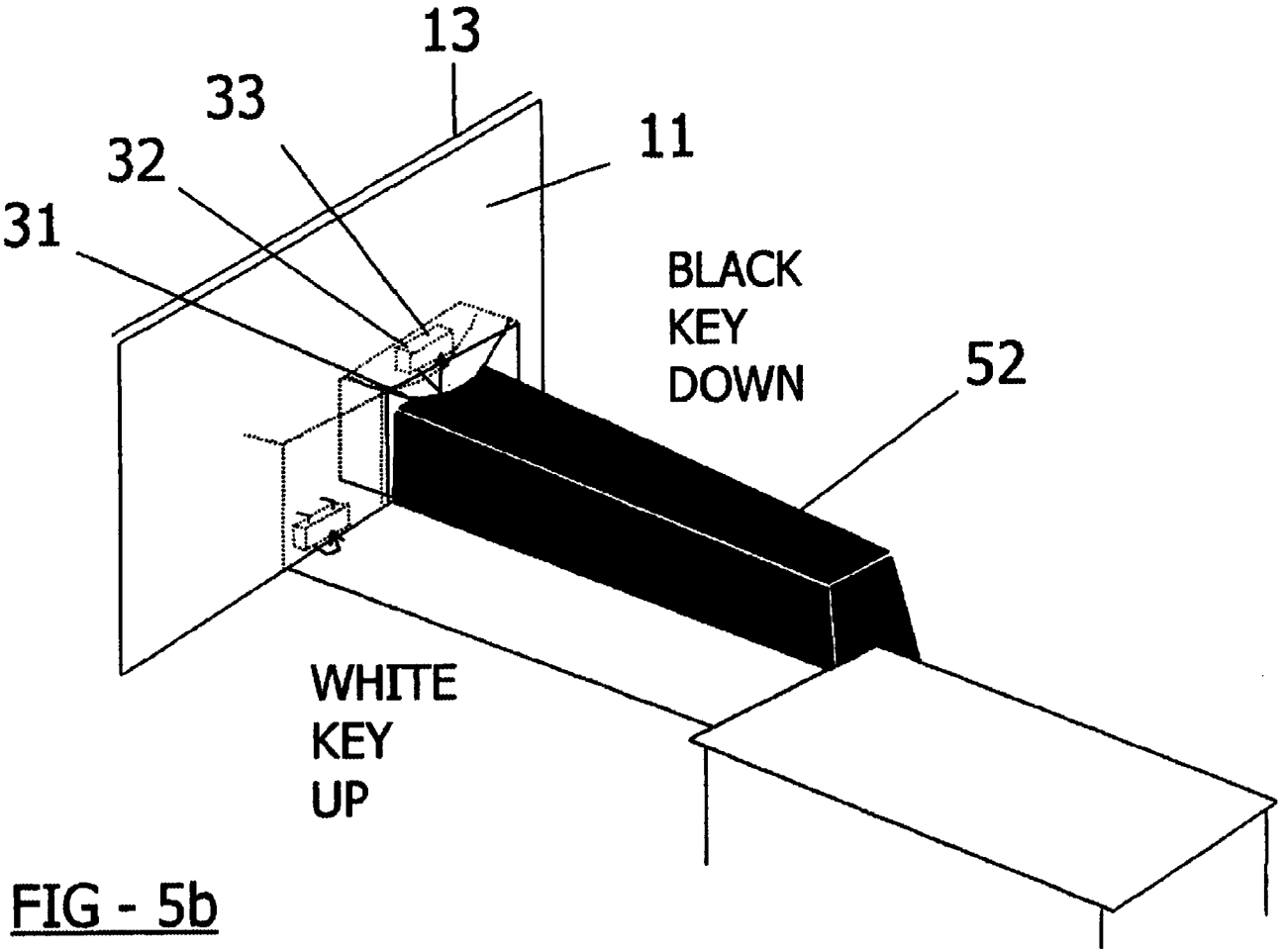

In the case of the horizontally-mounted insert, or drape, as shown in FIG. 5, the black key 51, at rest, pushes the drape 31 up against the optocoupler. As the black key is played and moves to the down position 52, the drape 31 moves down and away from the photo-emitter 32. This causes less light to be reflected, and the phototransistor's 33 signal decreases.

What is claimed is:

1. A device for use with a piano, organ, or musical keyboard, comprising:

a circuitry and detection device to detect and communicate white key and black key movement;

a surface of at least one of the white keys and black keys other than a visual surface of the key operatively connected to said detection device for detecting key movement.

2. The device of claim 1 wherein said surface comprises a plurality of flexible inserts disposed only at a back of the key, each of said inserts positionable between a key of the keyboard and said detection device, said insert changing position in relation to movement of said key.

3. The device of claim 2 wherein said flexible insert comprises at least one vertically-mounted insert positionable between a black key and said detection device and said insert changes position in relation to movement of said key.

4. The device of claim 2 wherein said flexible insert comprises at least one horizontally-mounted insert positionable between a black key and said detection device and said insert changes position in relation to movement of the key.

5. The device of claim 1 wherein each of said detection devices is locatable behind a rear vertical surface of a black key of the keyboard, said detection device detecting said black key movement from a surface of a black key.

6. A device for use with a piano, organ, or musical keyboard, comprising:

a rectangular backside cover adapted for mounting on the keyboard for detecting key movement, said cover disposed between the black keys of the keyboard and fallboard.

* * * * *